US008905406B2

(12) United States Patent
Brown

(10) Patent No.: US 8,905,406 B2
(45) Date of Patent: Dec. 9, 2014

(54) PORTABLE POINT/BEER PONG TABLE

(76) Inventor: Kevin J. Brown, Middletown, NJ (US)

( * ) Notice: Subject to any disclaimer, the term of this patent is extended or adjusted under 35 U.S.C. 154(b) by 183 days.

(21) Appl. No.: 13/404,250

(22) Filed: Feb. 24, 2012

(65) Prior Publication Data

US 2012/0256378 A1 Oct. 11, 2012

Related U.S. Application Data

(60) Provisional application No. 61/516,905, filed on Apr. 8, 2011.

(51) Int. Cl.

| | |
|---|---|
| ***A63B 63/08*** | (2006.01) |
| ***A63B 67/00*** | (2006.01) |
| ***A63B 67/06*** | (2006.01) |
| *A63F 7/00* | (2006.01) |
| *A63B 71/06* | (2006.01) |

(52) U.S. Cl.

CPC ..... *A63B 63/08* (2013.01); *A63B 67/002* (2013.01); *A63B 67/066* (2013.01); *A63F 7/0017* (2013.01); *A63B 2071/0694* (2013.01); *A63B 2210/50* (2013.01); *A63F 2250/024* (2013.01)

USPC ..... 273/400; 273/342

(58) Field of Classification Search

USPC ..... 273/398–402, 317, 342; 473/479; D21/303

See application file for complete search history.

(56) References Cited

U.S. PATENT DOCUMENTS

| | | | | | |
|---|---|---|---|---|---|
| 593,343 | A | * | 11/1897 | Whitney | 273/400 |
| 1,616,270 | A | * | 2/1927 | Madden | 273/401 |
| 1,872,454 | A | * | 8/1932 | Horn et al. | 124/7 |
| 2,608,454 | A | | 8/1952 | Slattery | |
| 2,744,752 | A | * | 5/1956 | Arnold | 273/398 |
| 3,001,791 | A | | 9/1961 | Atwood | |
| 3,372,934 | A | | 3/1968 | Heil | |
| 3,495,830 | A | * | 2/1970 | Farrelli | 273/400 |
| 3,820,789 | A | * | 6/1974 | Dudley | 273/400 |
| 4,177,737 | A | | 12/1979 | Brickman | |
| 4,273,340 | A | * | 6/1981 | Hackett | 273/336 |
| 5,632,490 | A | * | 5/1997 | Brown | 273/350 |
| D380,500 | S | * | 7/1997 | Cusumano | D21/303 |
| 6,244,598 | B1 | * | 6/2001 | Conville | 273/402 |
| 7,325,807 | B1 | | 2/2008 | Eason | |
| 7,516,960 | B1 | * | 4/2009 | Battiste | 273/342 |
| 7,805,959 | B2 | * | 10/2010 | Webb et al. | 62/457.3 |
| 8,146,921 | B2 | * | 4/2012 | Lombardi | 273/342 |
| 8,205,887 | B2 | * | 6/2012 | Wyland | 273/342 |
| 8,226,087 | B2 | * | 7/2012 | Brustmeyer | 273/342 |
| 2002/0129746 | A1 | | 9/2002 | Donnelly | |
| 2004/0188942 | A1 | | 9/2004 | Trokan | |
| 2005/0029747 | A1 | | 2/2005 | Grayson | |
| 2006/0226606 | A1 | | 10/2006 | Finley | |
| 2007/0045964 | A1 | * | 3/2007 | Petras | 273/317 |
| 2007/0063447 | A1 | * | 3/2007 | Gholson et al. | 273/400 |
| 2009/0194941 | A1 | | 8/2009 | Boyd | |
| 2010/0044964 | A1 | * | 2/2010 | Constantine et al. | 273/378 |
| 2010/0140873 | A1 | * | 6/2010 | Britton et al. | 273/398 |
| 2010/0244384 | A1 | | 9/2010 | Hofer | |
| 2011/0089640 | A1 | * | 4/2011 | Pecherski | 273/400 |
| 2012/0169012 | A1 | * | 7/2012 | Parker et al. | 273/400 |

* cited by examiner

*Primary Examiner* — Mark Graham
(74) *Attorney, Agent, or Firm* — Thomas J. Puppa

(57) ABSTRACT

This invention will provide a portable point/beer pong game for individual or team use. The invention is portable where it can be broken down, carried or stored in a bag, or other suitable container. The invention can be used as a 'Beer Pong' game as is common or it can be used as a game where points are scored. The invention top can also be used as a floating game in a swimming pool.

12 Claims, 5 Drawing Sheets

PORTABLE POINT/BEER PONG TABLE

CROSS REFERENCE TO RELATED APPLICATIONS

This application claims the benefit under 35 U.S.C. §119(e) of U.S. Provisional Patent Application No. 61/516,905, filed on Apr. 8, 2011, the contents of which are relied upon and incorporated by reference.

BACKGROUND OF THE INVENTION

1. Field of the Invention

This invention will provide a game for individual or team use. The invention is portable where it can be broken down, carried or stored in a bag, or other suitable container. The invention can be used as a 'Beer Pong' game as is common or it can be used as a game where points are scored. The invention top can also be used as a floating game in a swimming pool.

2. Description of Related Art

Relevant prior art includes:

U.S. Pat. No. 7,325,807 February, 2008 Eason

U.S. Pat. No. 7,805,959 May, 2010 Webb

Other fields of class searched include: 273/342; 273/400; 473/496; 62/457.3; 108/25

Beer-Pong, or Beirut, is a drinking game that is a popular party game, particularly among young people, such as college students. Although there are many local variations in the rules of the game, typically the game comprises two teams of two people each. The game is played on a conventional ping-pong table, or a table similar in dimensions to a ping-pong table, but without the net across the center of the table. The teams have a group of drinking cups, e.g., 16-ounce cups, arranged in a close fitting triangular pattern, similar to racked billiard balls, 10 placed centrally at opposite ends of the table. The cups are filled, or half-filled, with a beverage, typically beer, although malt liquor or other alcoholic or nonalcoholic beverages may be substituted.

The purpose of the game is for each team to take turns trying to eliminate the other team's cups by throwing ping-pong balls into the cups. Any cup that a ping pong ball falls into will be taken out of play, and a member of the team whose cup was eliminated must drink the beer or other beverage contained in the cup. Depending upon the number of cups remaining, the cups may be rearranged into a diamond configuration or other configuration as cups are eliminated. The objective is to eliminate the opposing team's cups first, and the victor is the team that does so.

Setting up the cups into a tight configuration of rows forming the triangle with the rims of the cups abutting one another can take some time. Moreover, the cups can slip or slide on the table. Many times the tables used are large and cumbersome. The existing large tables are not meant to crossover use between land and water.

Consequently, there is a need for a device that enables quick setup, which retains the cups in a tight configuration, which allows for non drinkers of any age to play the game and that can also be used in a swimming pool Thus small tables at either end, with precut holes, designated sections for points and can be used on land or in a pool are desired.

BRIEF SUMMARY OF THE INVENTION

Although others have beer pong tables and cup holders, my invention is superior because:

It takes up less room to play.

It can be played at different distances.

It converts to a swimming pool game.

It is meant for all age groups.

It has special cup holders for wash cup and cups out of play.

It has the proper size holes to fit normally used 16 oz. 'party cups'.

BRIEF DESCRIPTION OF THE DRAWINGS

Drawings

Figures

REFERENCE NUMERALS

10—table top
11—adapter piece
12—leg
13—base
14—cup holder
15—extension piece
16—large cup hole
17—receptacle for cup holder
18—receptacle for clip
19—clip and line set
20—tab
21—completed table assembly

DETAILED DESCRIPTION OF THE INVENTION

The game can be played as a traditional beer pong game or as a point game where a set number of points are given for landing the ball in different cups on the board. There will be two complete tables with each set.

Figure 1:
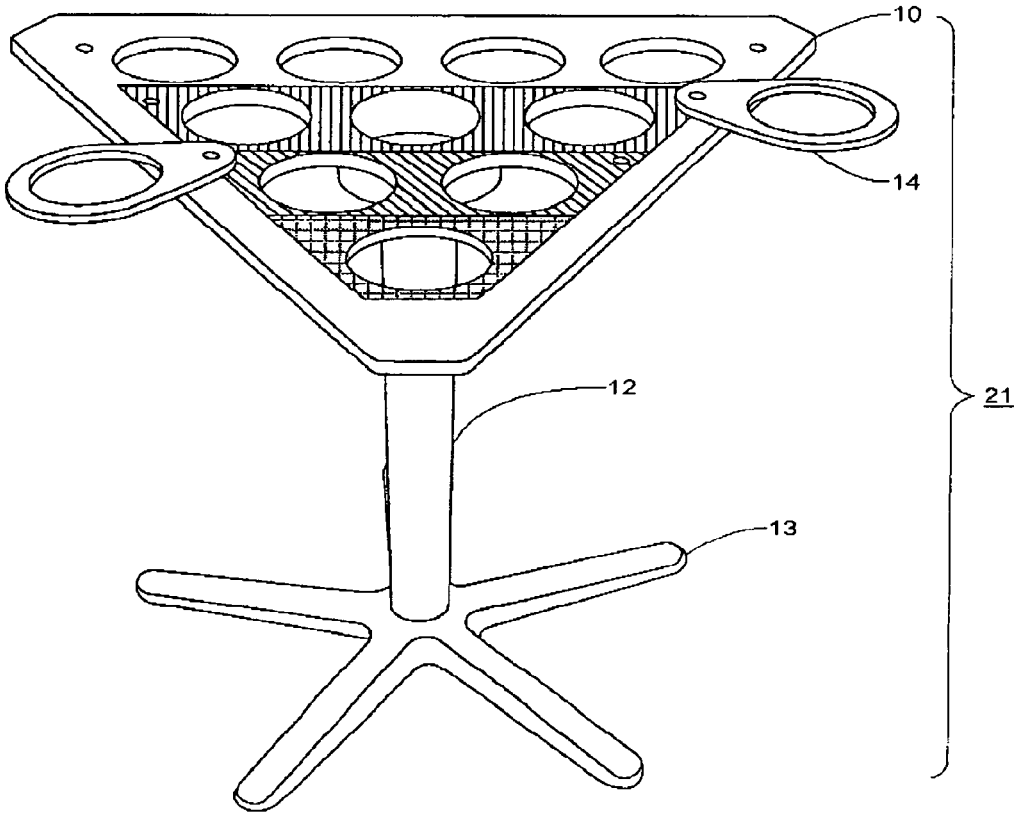
FIG. 1—is a perspective view of an assembled table.

FIG. 1 shows the completed table assembly 21 where the leg 12 attaches to the base 13. The adapter 11 is affixed onto a leg 12. The table top 10 with the extension piece 15 will fit into an adapter piece 11. FIG. 1 also shows the cup holder 14

Figure 2:
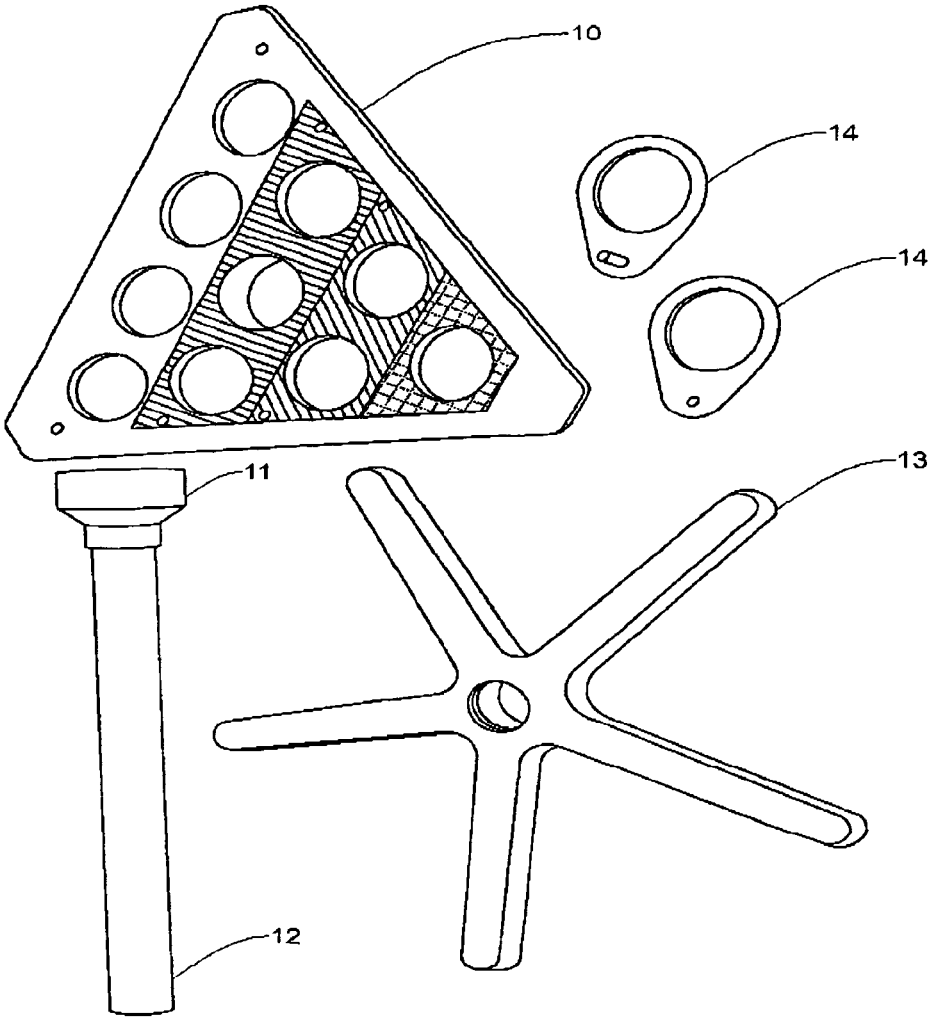
FIG. 2—is a perspective view of the components apart.

FIG. 2 shows a base 13, a leg 12, an adapter 11 which will be affixed onto one end of a leg, and a table top 10. A table top 10 is triangular in this embodiment but can be made in other shapes as well. A base 13 in this embodiment is star shaped but also can be made in other shapes as well. The materials can be made of wood, plastic, or other suitable materials.

Figure 3:
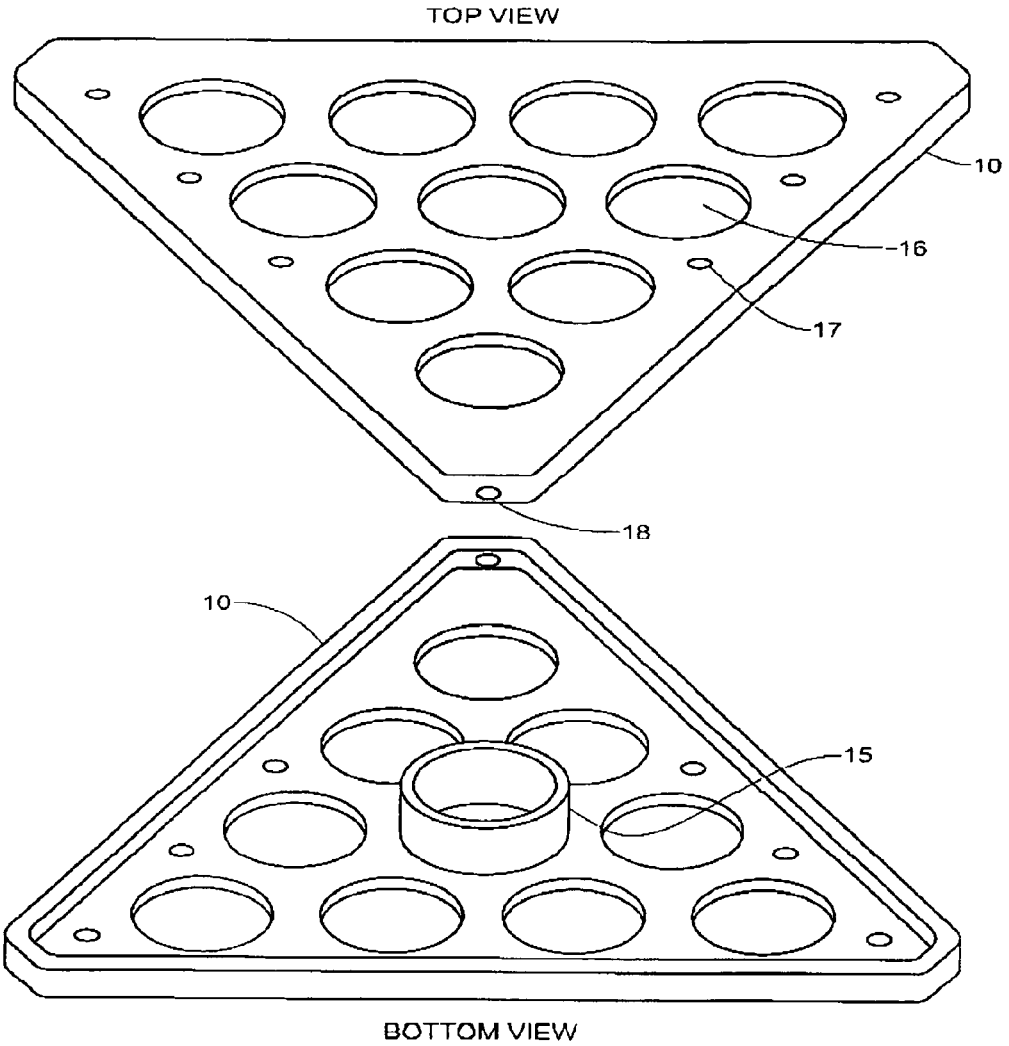
FIG. 3—is a perspective view of a top of the table and a bottom of the table.

FIG. 3 shows a top view of a table top 10, with the large cup holes 16, the receptacle for cup holder 17 and the receptacle for clip 18. FIG. 3 also shows a bottom view of a table top 10 with the extension piece 15.

Figure 4:
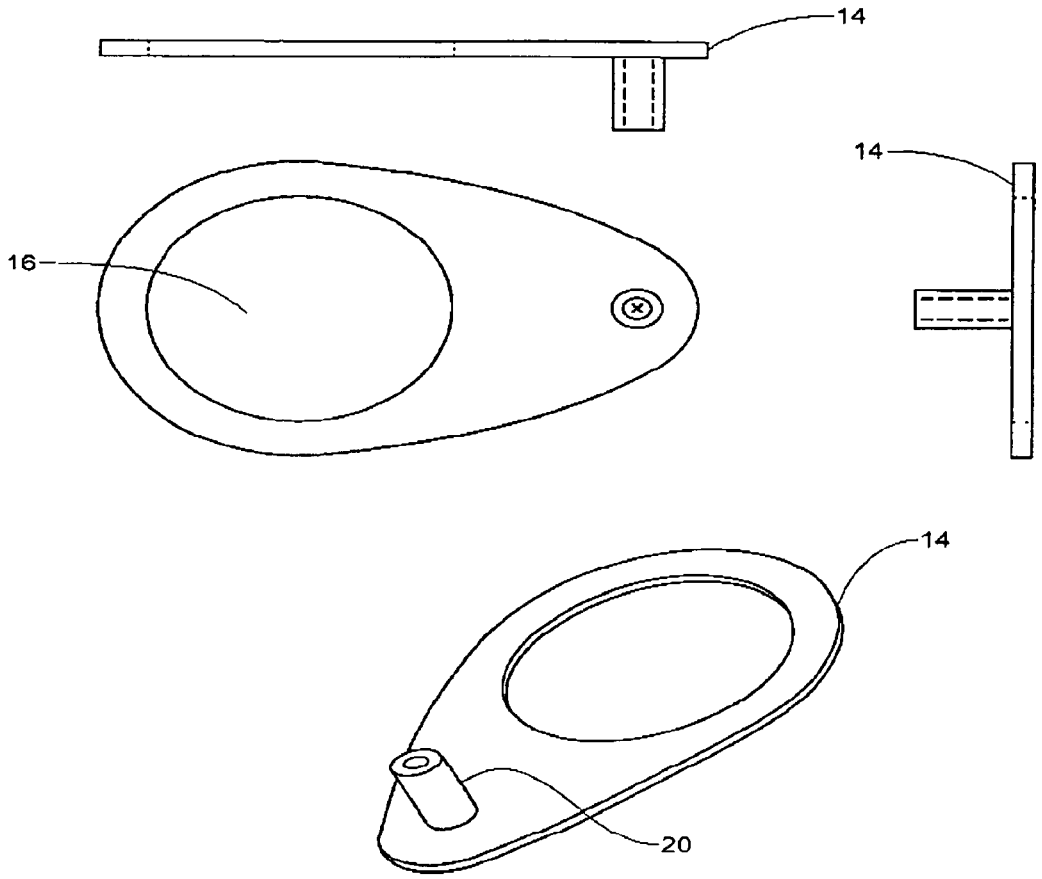
FIG. 4—is a view from all sides of a cup holder.

FIG. 4 shows a cup holder 14 with a large cup hole 16. The tab 20 will go into a receptacle for cup holder 17 on top of the table top 10. A cup holder 14 will swing away from the table top 10 when in use or can swing back over a large cup hole 16 when not in use. The cup holder 14 will be used to hold 'wash cups' or cups out of play.

Figure 5:
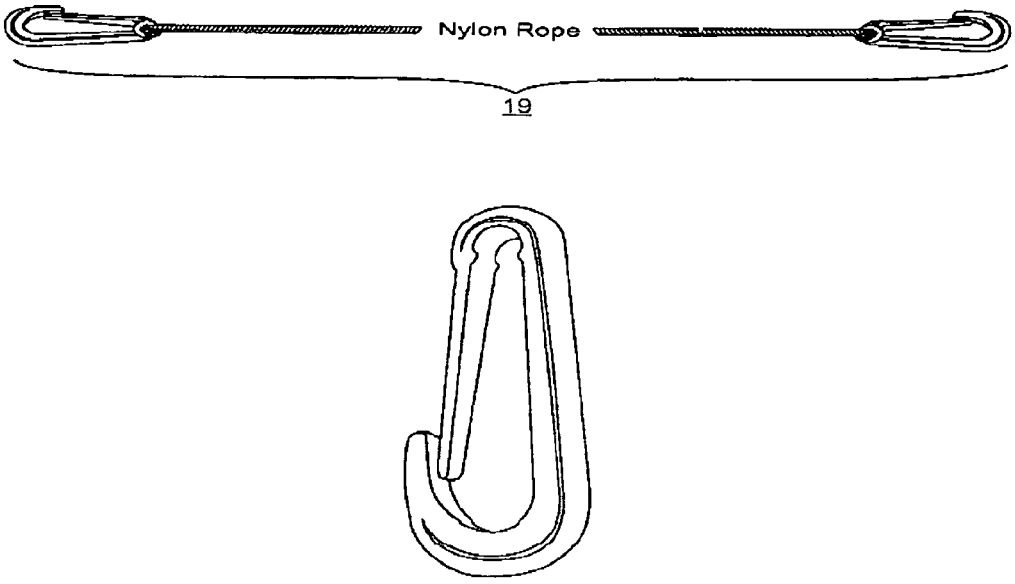
FIG. 5—is a view of a clip and line set.

FIG. 5 shows a clip and line set 19. This will be attached to table top 10 at receptacle for clip 18. This will be used to as a horizontal measuring device to keep the two completed table assemblies 21 at the same distance apart.

Table top 10 as shown in FIG. 1 and FIG. 2 can also be used independently in a swimming pool for both point pong and beer pang.

A game can be played with one table or two.

The inventor of the point/beer pong table has alternative methods of embodying his invention as described below:

A leg can be of a telescopic style or folding style.

A base can be of a tripod style.

Different materials, sizes, and interconnections can be used for all components.

Although the description above contains many examples, these should not be construed as limiting the scope of the invention but as merely providing illustrations of some of the presently preferred embodiments of this invention. The scope of the invention should therefore be determined by the appended claims and their legal equivalents.

I hereby claim:

1. A portable point/beer pong table game comprising:

a plurality of inserts, each insert independently removable, wherein each insert is a drinking cup further comprising a cup section and a rim section;

a plurality of independent table assemblies;

each table assembly comprising a planar table top;

the table top comprising an upper surface, an opposing bottom surface and a plurality of first holes extending from said upper surface to said opposing bottom surface; each said first hole adapted to hold an insert;

the table top further comprising a plurality of second holes disposed about its periphery and a drinking cup holder, each of said second holes being adapted to retain the drinking cup holder, each drinking cup holder being independently removable from said table top periphery and being adapted to hold a drinking cup in a position adjacent to the outside edge of the table top; and a removable leg assembly comprising a base and a leg, the leg adapted for supporting the table top above the base.

2. The portable point/beer pong table game according to claim 1, wherein the removable leg assembly comprises a plurality of legs.

3. The portable point/beer pong table game according to claim 1, wherein the removable leg assembly comprises a tripod.

4. The portable point/beer pong table game according to claim 1, wherein the rim section of each drinking cup abuts the rim section of one or more other drinking cups.

5. The portable point/beer pong table game according to claim 1, further comprising a table top with first holes arranged in a triangle pattern.

6. The portable point/beer pong table game according to claim 1, further comprising a table top with first holes arranged in a diamond pattern.

7. The portable point/beer pong table game according to claim 1, further comprising a rope with 2 ends, each end having a clip, wherein the clip is removably attached to each table top.

8. The portable point/beer gong table game according to claim 1, wherein the table top upper surface is color coded.

9. The portable point/beer pong table game according to claim 1, wherein an insert is color coded.

10. A portable point/beer pong table game comprising:

a plurality of inserts, each insert independently removable, wherein each insert is a drinking cup further comprising a cup section and a rim section;

a plurality of independent table assemblies;

each table assembly comprising a planar table top;

the table top comprising an upper surface, an opposing bottom surface and a plurality of first holes extending from said upper surface to said opposing bottom surface; each said first hole adapted to hold an insert:

the table top further comprising a plurality of second holes disposed about its periphery and a drinking cup holder, each of said second holes being adapted to retain the drinking cup holder, each drinking cup holder being independently removable from said table top periphery and being adapted to hold a drinking cup in a position adjacent to the outside edge of the table top; and a means for supporting the table top above a surface.

11. The portable point/beer pong table game according to claim 10, further comprising a support means for supporting the table top on a solid surface.

12. The portable point/beer pong table game according to claim 10, further comprising a support means for supporting the table top on water.

* * * * *